US011532285B2

(12) United States Patent
Kang

(10) Patent No.: US 11,532,285 B2
(45) Date of Patent: Dec. 20, 2022

(54) DISPLAY DEVICE AND CONTROL METHOD THEREFOR

(71) Applicant: SAMSUNG ELECTRONICS CO., LTD., Suwon-si (KR)

(72) Inventor: Jeongil Kang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/436,508

(22) PCT Filed: Mar. 30, 2020

(86) PCT No.: PCT/KR2020/004353
§ 371 (c)(1),
(2) Date: Sep. 3, 2021

(87) PCT Pub. No.: WO2020/204542
PCT Pub. Date: Oct. 8, 2020

(65) Prior Publication Data

US 2022/0180826 A1 Jun. 9, 2022

(30) Foreign Application Priority Data

Apr. 1, 2019 (KR) ..... 10-2019-0037812

(51) Int. Cl.
*G09G 3/34* (2006.01)

(52) U.S. Cl.
CPC ..... *G09G 3/3406* (2013.01); *G09G 3/34* (2013.01); *G09G 2320/0626* (2013.01); *G09G 2330/02* (2013.01)

(58) Field of Classification Search
CPC ..... G09G 3/34; G09G 2330/02
See application file for complete search history.

(56) References Cited

U.S. PATENT DOCUMENTS 8,462,276 B2 6/2013 Lowe et al.
9,013,712 B2 4/2015 Park
(Continued)

FOREIGN PATENT DOCUMENTS

JP 2002-369404 A 12/2002
JP 2018-112964 A 7/2018
(Continued)

OTHER PUBLICATIONS

English translation of KR20080089908, Inventor Yoo, , publication on Oct. 8, 2008,.LCD Module With Color Light Emitting Frame (Year: 2008).*

(Continued)

*Primary Examiner* — William Boddie
*Assistant Examiner* — Saifeldin E Elnafia
(74) *Attorney, Agent, or Firm* — Sughrue Mion, PLLC

(57) ABSTRACT

A display device and controlling method are provided. The display device includes a display including a display panel and a backlight unit arranged on the rear surface of the display panel, a light emitting frame including a plurality of light emitting elements, the light emitting frame being arranged on at least one edge of the display, a backlight driver, and a processor configured to control the backlight driver so as to supply power to the backlight unit based on an event for turning on the display occurring, and supply power to the light emitting frame based on an event for turning off the display occurring.

9 Claims, 18 Drawing Sheets

(56) References Cited

U.S. PATENT DOCUMENTS

| | | | | |
|---|---|---|---|---|
| 9,159,272 | B2 | 10/2015 | Murai et al. | |
| 9,310,634 | B2 | 4/2016 | Jepsen | |
| 10,182,475 | B2 | 1/2019 | Kang | |
| 2008/0204395 | A1* | 8/2008 | Kang | H05B 45/14 345/102 |
| 2012/0050343 | A1* | 3/2012 | Kim | G09G 3/3406 345/690 |
| 2013/0307879 | A1* | 11/2013 | Park | G09G 3/035 345/212 |
| 2015/0177538 | A1 | 6/2015 | Jepsen | |
| 2016/0309555 | A1 | 10/2016 | Kang | |
| 2017/0018230 | A1* | 1/2017 | Im | H05B 45/10 |
| 2018/0073720 | A1 | 3/2018 | Bruyneel et al. | |
| 2018/0260602 | A1 | 9/2018 | He et al. | |

FOREIGN PATENT DOCUMENTS

| | | | |
|---|---|---|---|
| KR | 10-2008-0089908 | A | 10/2008 |
| KR | 10-2010-0027718 | A | 3/2010 |
| KR | 10-1152425 | B1 | 6/2012 |
| KR | 20-2013-0004250 | U | 7/2013 |
| KR | 10-2013-0128691 | A | 11/2013 |
| KR | 10-2016-0103064 | A | 8/2016 |
| KR | 10-2016-0124590 | A | 10/2016 |
| KR | 10-1664008 | B1 | 10/2016 |
| KR | 10-1796709 | B1 | 11/2017 |
| KR | 10-2018-0057901 | A | 5/2018 |
| WO | 2008/120879 | A1 | 10/2008 |

OTHER PUBLICATIONS

International Search Report (PCT/ISA/210) dated Jul. 10, 2020 by the International Searching Authority in counterpart International Application No. PCT/KR2020/004353.

Written Opinion (PCT/ISA/237) dated Jul. 10, 2020 by the International Searching Authority in counterpart International Application No. PCT/KR2020/004353.

* cited by examiner

DISPLAY DEVICE AND CONTROL METHOD THEREFOR

CROSS-REFERENCE TO RELATED APPLICATION(S)

This application is a national stage entry of International Application PCT/KR2020/004353 filed on Mar. 30, 2020, which claims benefit of Korean Application No. 10-2019-0037812 filed on Apr. 1, 2019, the disclosures of which are incorporated herein in their entireties by reference.

BACKGROUND

1. Field

The disclosure generally relates to a display device and a control method therefor, and more particularly, to a display device equipped with a lighting function, and a control method therefor.

2. Description of the Related Art

Spurred by the development of electronic technologies, various types of electronic devices are being developed and distributed. In particular, display devices such as a television (TV) which is one of the home appliances that are used the most in general homes are being developed rapidly in recent few years.

However, there is a problem that a TV fully performs its intrinsic function only when a user views a content, and in case a user does not view a content, it is degraded into a black unsightly object that is positioned in the most noticeable location indoors.

SUMMARY

The disclosure is for addressing the aforementioned need, and the purpose of the disclosure is in providing a display device that operates as a lighting in case a display device is turned off, and a control method therefor.

According to an embodiment of the disclosure a display device includes a display including a display panel and a backlight unit arranged on the rear surface of the display panel, a light emitting frame including a plurality of light emitting elements, the light emitting frame being arranged on at least one edge of the display, a backlight driver, and a processor configured to control the backlight driver so as to supply power to the backlight unit based on an event for turning on the display occurring, and supply power to the light emitting frame based on an event for turning off the display occurring.

Here, the processor may, based on an event for turning off the display occurring, control the backlight driver so as to stop supply of power to the backlight unit, and supply power to the light emitting frame.

Also, the backlight driver may include a constant current supply circuit which adjusts a size of a constant current based on a dimming signal output from the processor, and provide a constant current output from the constant current supply circuit to one of the backlight unit or the light emitting frame based on a level of a selection signal provided from the processor.

In addition, the backlight driver may further include a discharge circuit connected to an output end of the constant current supply circuit, and the processor may, based on an event changing the display from a turned-on state to a turned-off state or from a turned-off state to a turned-on state occurring, stop output of the dimming signal and control the backlight driver such that the discharge circuit operates during a first threshold time, and output the dimming signal after a second threshold time after changing the level of the selection signal.

Further, the processor may, based on the event changing the display from a turned-on state to a turned-off state or from a turned-off state to a turned-on state, stop output of the dimming signal and identify at least one of whether the discharge circuit operates or an operating time based on a driving voltage of the backlight unit and a driving voltage of the light emitting frame.

Also, the first threshold time may be determined based on the driving voltage of the backlight unit and the driving voltage of the light emitting frame.

In addition, the backlight driver may further include a capacitor connected to the output end of the constant current supply circuit, and the discharge circuit may include a resistance of which one end is connected to one end of the capacitor, and a transistor of which one end is connected to the other end of the resistance, and of which the other end is connected to the other end of the capacitor. Also, the processor may control an operation of the discharge circuit by applying a discharge signal to a control terminal of the transistor.

Further, the backlight driver may include an inverter, a first transistor which is serially connected to the backlight unit, and of which a control terminal is connected to one of an input end of the inverter or an output end of the inverter, and a second transistor which is serially connected to the plurality of light emitting elements included in the light emitting frame, and of which a control terminal is connected to the input end of the inverter when the control terminal of the first transistor is connected to the output end of the inverter or the output end of the inverter when the control terminal of the first transistor is connected to the input end of the inverter. In addition, the processor may apply the selection signal to the input end of the inverter and control the backlight driver such that the constant current is provided to one of the backlight unit or the light emitting frame.

Also, the light emitting frame may include a first terminal and a second terminal shorted from the first terminal, and the processor may apply a reference signal to one of the first terminal or the second terminal, and identify whether the light emitting frame is installed based on whether the reference signal is detected from the first terminal when the reference signal is applied to the second terminal or the second terminal when the reference signal is applied to the first terminal.

In addition, the processor may, based on identifying that the light emitting frame is not installed on the display device, if an event for turning off the display occurs, stop the driving of the backlight driver.

Further, the light emitting frame may include a shield for shielding emission of a light emitted from the light emitting frame to the front side of the display device.

Meanwhile, a method for controlling a display device including a display panel and a backlight unit arranged on the rear surface of the display panel, a light emitting frame including a plurality of light emitting elements, the light emitting frame being arranged on at least one edge of the display, and a backlight driver according to an embodiment of the disclosure includes the steps of identifying an event for turning on or turning off the display, and controlling the backlight driver so as to supply power to the backlight unit based on an event for turning on the display occurring, and supply power to the light emitting frame based on an event for turning off the display occurring.

Here, in the controlling step, based on an event for turning off the display occurring, the backlight driver may be controlled so as to stop supply of power to the backlight unit, and supply power to the light emitting frame.

Also, the controlling step may include the steps of applying a dimming signal to the backlight driver and adjusting a size of a constant current output from a constant current supply circuit included in the backlight driver, and providing the constant current to one of the backlight unit or the light emitting frame based on a level of a selection signal applied to the backlight driver.

In addition, the controlling step may include the steps of, based on an event changing the display from a turned-on state to a turned-off state or from a turned-off state to a turned-on state occurring, stopping output of the dimming signal, controlling the backlight driver such that a discharge circuit connected to an output end of the constant current supply circuit operates during a first threshold time, and outputting the dimming signal after a second threshold time after changing the level of the selection signal.

Further, in the step of controlling the backlight driver such that the discharge circuit operates, at least one of whether the discharge circuit operates or an operating time may be identified based on a driving voltage of the backlight unit and a driving voltage of the light emitting frame.

Also, the first threshold time may be determined based on the driving voltage of the backlight unit and the driving voltage of the light emitting frame.

In addition, the discharge circuit may include a resistance of which one end is connected to one end of a capacitor connected to the output end of the constant current supply circuit, and a transistor of which one end is connected to the other end of the resistance, and of which the other end is connected to the other end of the capacitor. Also, in the step of controlling the backlight driver such that the discharge circuit operates, an operation of the discharge circuit may be controlled by applying a discharge signal to a control terminal of the transistor.

Further, the backlight driver may include an inverter, a first transistor which is serially connected to the backlight unit, and of which a control terminal is connected to one of an input end of the inverter or an output end of the inverter, and a second transistor which is serially connected to the plurality of light emitting elements included in the light emitting frame, and of which a control terminal is connected to the input end of the inverter when the control terminal of the first transistor is connected to the output end of the inverter or the output end of the inverter when the control terminal of the first transistor is connected to the input end of the inverter. In addition, in the step of providing, the selection signal may be applied to the input end of the inverter and the backlight driver may be controlled such that the constant current is provided to one of the backlight unit or the light emitting frame.

Also, the control method may further include the steps of applying a reference signal to one of a first terminal which is included in the light emitting frame or a second terminal which is included in the light emitting frame and which is shorted from the first terminal, and identifying whether the light emitting frame is installed based on whether the reference signal is detected from the first terminal when the reference signal is applied to the second terminal or the second terminal when the reference signal is applied to the first terminal.

In addition, in the controlling step, based on identifying that the light emitting frame is not installed on the display device, if an event for turning off the display occurs, the driving of the backlight driver may be stopped.

Further, the light emitting frame may include a shield for shielding emission of a light emitted from the light emitting frame to the front side of the display device.

According to the various embodiments of the disclosure as described above, a display device operates as a lighting, and thus its usability is reinforced, and as there is no need to include a separate backlight driver, the production cost can be reduced.

DETAILED DESCRIPTION

Figure 1:
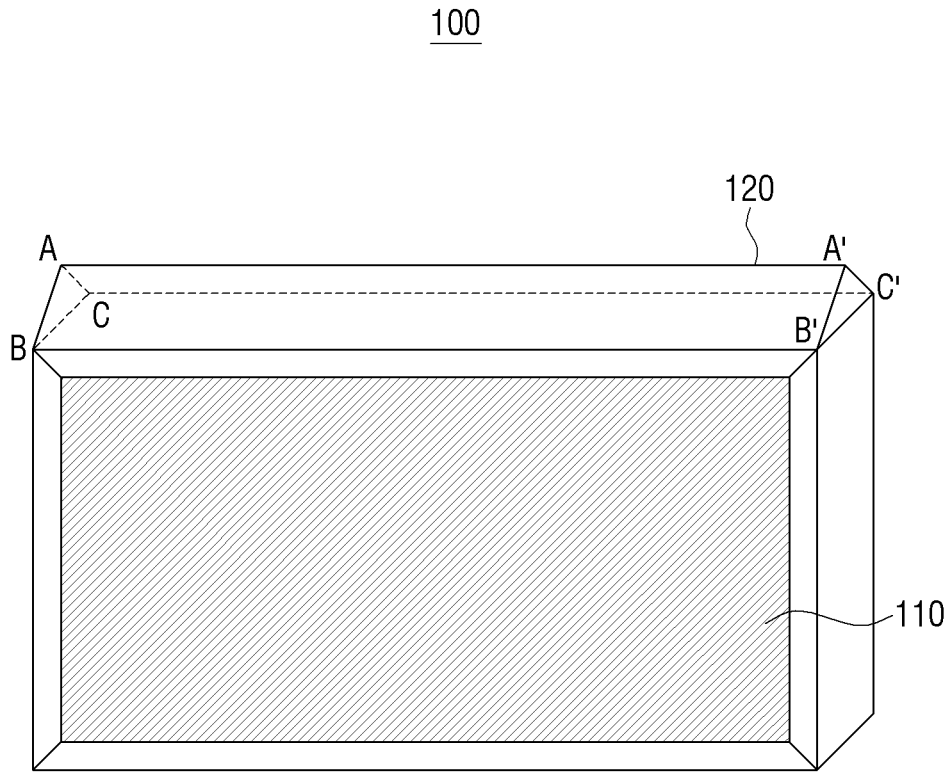
FIG. 1 is a diagram for illustrating an exterior of a display device according to an embodiment of the disclosure.

Hereinafter, the disclosure will be described in detail with reference to the accompanying drawings.

As terms used in the embodiments of the disclosure, general terms that are currently used widely were selected as far as possible, in consideration of the functions described in the disclosure. However, the terms may vary depending on the intention of those skilled in the art, previous court decisions, or emergence of new technologies, etc. Also, in particular cases, there may be terms that were arbitrarily designated by the applicant, and in such cases, the meaning of the terms will be described in detail in the relevant descriptions in the disclosure. Accordingly, the terms used in the disclosure should be defined based on the meaning of the terms and the overall content of the disclosure, but not just based on the names of the terms.

Also, in this specification, expressions such as "have," "may have," "include," and "may include" denote the existence of such characteristics (e.g.: elements such as numbers, functions, operations, and components), and do not exclude the existence of additional characteristics.

In addition, the expression "at least one of A and/or B" should be interpreted to mean any one of "A" or "B" or "A and B."

Further, the expressions "first," "second," and the like used in this specification may describe various elements regardless of any order and/or degree of importance. Also, such expressions are used only to distinguish one element from another element, and are not intended to limit the elements.

In addition, the description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element).

Also, singular expressions include plural expressions, as long as they do not obviously mean differently in the context. In addition, in the disclosure, terms such as "include" and "consist of" should be construed as designating that there are such characteristics, numbers, steps, operations, elements, components, or a combination thereof described in the specification, but not as excluding in advance the existence or possibility of adding one or more of other characteristics, numbers, steps, operations, elements, components, or a combination thereof.

Meanwhile, in the disclosure, "a module" or "a part" performs at least one function or operation, and it may be implemented as hardware or software, or as a combination of hardware and software. Further, a plurality of "modules" or "parts" may be integrated into at least one module and implemented as at least one processor (not shown), except "modules" or "parts" which need to be implemented as specific hardware.

In addition, in this specification, the term "user" may refer to a person who uses an electronic device or a device using an electronic device (e.g.: an artificial intelligence electronic device).

Hereinafter, an embodiment of the disclosure will be described in more detail with reference to the accompanying drawings.

FIG. 1 is a diagram for illustrating an exterior of a display device 100 according to an embodiment of the disclosure.

The display device 100 may include a display 110. The display 110 may include a display panel and a backlight unit arranged on the rear surface of the display panel.

Here, the display panel may be a component for expressing colors, and the backlight unit may be a component for providing lights to the display panel or expressing luminance for each area of the display panel. For example, the display panel may include a plurality of fluorescent substances for expressing colors of each of a plurality of sub pixels, and the backlight unit may include a plurality of light emitting diodes for expressing luminance of each of the plurality of sub pixels. Here, the fluorescent substances are a type of light emitting materials and are substances that respectively absorb energy and emit lights such as a red light, a green light, a blue light, etc., and they may be inorganic fluorescent substances, organic fluorescent substances, quantum dots, etc.

However, the disclosure is not limited thereto, and the display panel may also be implemented as a liquid crystal. In this case, the backlight unit may also be implemented in a form of including one light emitting diode for each of a plurality of pixels. That is, the backlight unit may be implemented as direct type light emitting diodes (LEDs) or edge type LEDs.

Alternatively, the display 110 may also be implemented as organic LEDs (OLEDs) without a separate backlight unit, and the technology of the disclosure can be applied without any problem if the light emitting frame 120 is implemented such that a difference between the power driving the display 110 and the power driving the light emitting frame 120 that will be described below is not big. That is, any case is possible if the backlight unit or the light emitting frame 120 can be time-shared and controlled with one backlight driver.

The display device 100 may include a light emitting frame 120. The light emitting frame 120 may include a plurality of light emitting elements, and it may be arranged on at least one edge of the display 110. Here, the plurality of light emitting elements may be implemented as LEDs. However, the disclosure is not limited thereto, and the plurality of light emitting elements may also be implemented as any different types of light emitting elements. Also, the plurality of light emitting elements may also be implemented as light emitting elements of different types from one another.

The light emitting frame 120 may be implemented such that a light is emitted to the rear side of the display device 100. For example, as illustrated in FIG. 1, the light emitting frame 120 may be implemented such that a light is emitted through the ACC'A' surface, and a light is not emitted through the ABB'A' surface. For example, the ACC'A' surface of the light emitting frame 120 may be implemented as a material through which a light can pass, and the ABB'A' surface may be implemented as a material through which a light cannot pass.

In FIG. 1, it was illustrated that the light emitting frame 120 is in a form of a trigonal prism, but this is merely an embodiment, and the light emitting frame 120 may be implemented in any different forms if it is a form where a light is not emitted to the front side of the display device 100. In particular, the light emitting frame 120 may be in a form where a light is emitted to the rear side of the display device 100.

Meanwhile, in FIG. 1, it was described that a light is emitted through only the ABB'A' surface, but a light may be emitted through at least one of the ABC surface or the A'B'C' surface. Here, the light emitting frame 120 may further include a film that guides a light to be emitted toward the rear side rather than the front side of the display device 100.

Also, the light emitting frame 120 may include a magnet in the inside, and may be attached to at least one edge of the display 110 through a magnetic force. Here, the display 110 may include a magnet in a location corresponding to the magnet included in the light emitting frame 120. Alternatively, the display 110 may be implemented as a material where the location corresponding to the magnet included in the light emitting frame 120 responds to a magnetic force.

Figure 2:
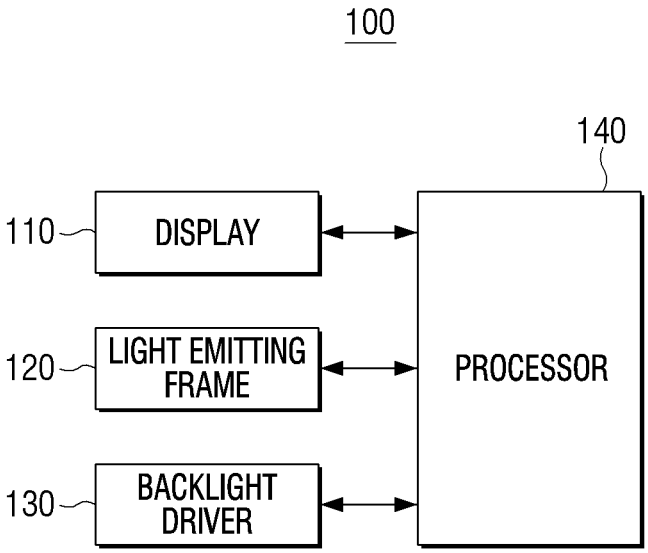
FIG. 2 is a block diagram illustrating a configuration of a display device according to an embodiment of the disclosure.

FIG. 2 is a block diagram illustrating a configuration of the display device 100 according to an embodiment of the disclosure. As illustrated in FIG. 2, the display device 100 includes a display 110, a light emitting frame 120, a backlight driver 130, and a processor 140.

The display 110 is a component that displays an image processed by the processor 140. The display 110 may be implemented as an LCD, LEDs, and a plasma display panel (PDP), etc., but is not limited thereto. Also, it is possible that the display 110 is implemented as a flexible display, a transparent display, etc. depending on cases.

The light emitting frame 120 may be arranged on at least one edge of the display 110, and include a plurality of light emitting elements. For example, the light emitting frame 120 may be arranged on the upper side of the display 110. However, the disclosure is not limited thereto, and the light emitting frame 120 may be arranged on edges on the upper, lower, left, and right sides of the display 110.

Alternatively, light emitting frames of different types from one another may be arranged while being divided to the upper, lower, left, and right sides. For example, a first light emitting frame may be arranged on the upper side of the display 110, and a second light emitting frame emitting a light of a different wavelength from the first light emitting frame may be arranged on the lower side of the display 110.

Meanwhile, the light emitting frame 120 may include a shield for shielding emission of a light emitted from the light emitting frame 120 to the front side of the display device 100. Here, the front side may be interpreted in different ways. First, based on a surface parallel to the display 110, 180 degrees in the direction of a viewer may be the front side, and 180 degrees in the remaining directions may be the rear side.

Alternatively, only the angles which are smaller than or equal to 180 degrees in the direction of a viewer based on a surface parallel to the display 110 may be the front side. For example, the front side may mean a front side corresponding to the display 110 of the display device 100. Specifically, in case a first user is in a location where the user does not need to turn his head to view a content displayed at the display device 100, and a second user is in a location where the user needs to turn his head to view a content displayed at the display device 100, even if the display 110 is turned off and power is supplied to the light emitting frame, the first user may not be directly exposed to a light emitted from the light emitting frame 120 by virtue of the shield, but the second user may be directly exposed to a light emitted from the light emitting frame 120. In this case, the front side of the display device 100 may mean some directions where the first user is located.

The backlight driver 130 applies power to the display 110 or the light emitting frame 120 by using external power. Specifically, the backlight driver 130 may apply a constant current as power to the display 110 or the light emitting frame 120 according to control of the processor 140. A specific configuration of the backlight driver 130 will be described together with the operation of the processor 140.

The processor 140 controls the overall operations of the display device 100.

According to an embodiment of the disclosure, the processor 140 may be implemented as a digital signal processor (DSP), a microprocessor, and a time controller (TCON). However, the disclosure is not limited thereto, and the processor 140 may include one or more of a central processing unit (CPU), a micro controller unit (MCU), a micro processing unit (MPU), a controller, an application processor (AP), or a communication processor (CP), and an ARM processor, or may be defined by the terms. Also, the processor 140 may be implemented as a system on chip (SoC) having a processing algorithm stored therein or large scale integration (LSI), or in the form of a field programmable gate array (FPGA).

The processor 140 may control the backlight driver 130 so as to supply power to the backlight unit if an event for turning on the display 110 occurs, and supply power to the light emitting frame 120 if an event for turning off the display 110 occurs.

For example, the processor 140 may control the backlight driver 130 so as to supply power to the backlight unit in case a user wishes to view a content by using the display 110, and supply power to the light emitting frame 120 when the user finishes viewing the content and turns off the display 110.

Here, if an event for turning off the display 110 occurs, the processor 140 may control the backlight driver 130 so as to stop supply of power to the backlight unit, and supply power to the light emitting frame 120.

Alternatively, if an event for turning on the display 110 occurs, the processor 140 may control the backlight driver 130 so as to stop supply of power to the light emitting frame 120, and supply power to the backlight unit.

Here, the backlight driver 130 may include a constant current supply circuit that adjusts a size of a constant current based on a dimming signal output from the processor 140, and provide a constant current output from the constant current supply circuit to one of the backlight unit or the light emitting frame 120 based on a level of a selection signal provided from the processor 140.

For example, in case a user views a content, the processor 140 may apply a selection signal of a first level to the backlight driver 130 and perform control such that a constant current output from the backlight driver 130 is applied to the backlight unit. Then, in case the user finishes viewing the content and turns off the display 110, the processor 140 may apply a selection signal of a second level to the backlight driver 130 and perform control such that a constant current output from the backlight driver 130 is applied to the light emitting frame 120. Here, the first level of the selection signal may be one of a high level or a low level, and the second level of the selection signal may be the other one of the high level or the low level.

Also, the processor 140 may apply a dimming signal which is a period signal where a signal of a specific time is applied during a period to the backlight driver 130, and adjust a size of a constant current output from the backlight driver 130. For example, the processor 140 may apply a pulse-width modulation (PWM) dimming signal where the high level or the low level is repeated to the backlight driver 130, and adjust a size of a constant current output from the backlight driver 130.

The ratio of a time where a signal regarding a period of a dimming signal is applied may be referred to as a duty ratio, and in the case of a PWM dimming signal, the ratio of the high level for a period becomes a duty ratio.

The processor 140 may adjust a size of a constant current output from the backlight driver 130 by changing a duty ratio. For example, the processor 140 may increase a size of a constant current output from the backlight driver 130 by making a high level section of a PWM dimming signal long and making a low level section of a PWM dimming signal short. That is, the processor 140 may increase a size of a constant current output from the backlight driver 130 by making a pulse width of a PWM dimming signal long.

The backlight driver 130 may further include a discharge circuit connected to an output end of the constant current supply circuit, and if an event changing the display 110 from a turned-on or turned-off state to the other state occurs, the processor 140 may stop output of the dimming signal and control the backlight driver 130 such that the discharge circuit operates during a first threshold time, and output the dimming signal after a second threshold time after changing the level of the selection signal.

In case the processor 140 stops output of the dimming signal, the backlight driver 130 may also stop output of the constant current. Through such an operation, damage to the circuit that may occur while supply of power is switched from one of the backlight unit or the light emitting frame 120 to the other can be prevented.

Also, as the driving voltage of the backlight unit and the driving voltage of the light emitting frame 120 may be different from each other, it is necessary to adjust the voltage of the output end of the constant current supply circuit through the discharge circuit. For example, in case the driving voltage of the backlight unit is higher than the driving voltage of the light emitting frame 120, and supply of power is switched from the backlight unit to the light emitting frame 120, if there is no discharge circuit, a relatively high voltage may be applied to the light emitting frame 120, and an excessive current may be generated and an unintended glaring phenomenon may occur. In this case, if a discharge circuit is provided, the voltage of the output end of the constant current supply circuit may be lowered, and generation of an excessive voltage may thereby be prevented.

Afterwards, the processor 140 may change the level of the selection signal, and output the dimming signal after the second threshold time after the time point of change.

Here, if an event changing the display 110 from a turned-on or turned-off state to the other state occurs, the processor 140 may stop output of the dimming signal, and identify at least one of whether the discharge circuit operates or an operating time based on the driving voltage of the backlight unit and the driving voltage of the light emitting frame 120.

For example, the processor 140 may detect the voltage of the output end of the constant current supply circuit, and control the backlight driver 130 such that the discharge circuit operates until the detected voltage becomes the driving voltage of the subject to which power will be supplied between the backlight unit and the light emitting frame 120 according to switching. If the detected voltage is lower than the driving voltage of the subject to which power will be supplied between the backlight unit and the light emitting frame 120 according to switching, the processor 140 may control the backlight driver 130 such that the discharge circuit does not operate.

In the above, a method for the processor 140 to flexibly control the discharge circuit was described. That is, the processor 140 may change the first threshold time depending on situations. However, this is merely an embodiment, and the processor 140 may use a predetermined first threshold time. In this case, the first threshold time may be determined based on the driving voltage of the backlight unit and the driving voltage of the light emitting frame 120. In particular, the first threshold time may be determined in further consideration of a capacitor included in the backlight driver 130 and a value of a resistance included in the discharge circuit that will be described below.

Meanwhile, the backlight driver 130 may further include a capacitor connected to the output end of the constant current supply circuit, and the discharge circuit may include a resistance of which one end is connected to one end of the capacitor and a transistor of which one end is connected to the other end of the resistance, and of which the other end is connected to the other end of the capacitor, and the processor 140 may control an operation of the discharge circuit by applying a discharge signal to a control terminal of the transistor. The processor 140 may operate the discharge circuit and discharge the voltage charged in the capacitor.

Meanwhile, the backlight driver 130 may include an inverter, a first transistor which is serially connected to the backlight unit, and of which a control terminal is connected to one of an input end of the inverter or an output end of the inverter, and a second transistor which is serially connected to the plurality of light emitting elements included in the light emitting frame 120, and of which a control terminal is connected to the other one of the input end of the inverter or the output end of the inverter. Also, the processor 140 may apply a selection signal to the input end of the inverter, and thereby control the backlight driver 130 such that a constant current is provided to one of the backlight unit or the light emitting frame 120.

A specific operation of the backlight driver 130 will be described below with reference to the drawings.

Meanwhile, the light emitting frame 120 may include a first terminal and a second terminal shorted from the first terminal, and the processor 140 may apply a reference signal to one of the first terminal or the second terminal, and identify whether the light emitting frame 120 is installed based on whether the reference signal is detected from the other one of the first terminal or the second terminal.

Here, in case it is identified that the light emitting frame 120 is not installed on the display 110, if an event for turning off the display 110 occurs, the processor 140 may stop the driving of the backlight driver 130.

The display device 100 may operate as a lighting even if it does not include a separate backlight driver through an operation as above. That is, according to the disclosure, without the backlight driver 130 for driving the backlight unit included in the display 110 and a driver for driving the light emitting frame 120 having to be included separately, the light emitting frame 120 may be driven by using the backlight driver 130 for driving the backlight unit. Thus, according to the disclosure, there is no need to separately include a dedicated driver for driving the light emitting frame 120, and accordingly, the production cost can be reduced as much as a dedicated driver for driving the light emitting frame 120.

More specifically, in case the display 110 is turned on, the processor 140 may control the backlight driver 130 so as to supply power to the backlight unit, and in case the display 110 is turned off, the processor 140 may control the backlight driver 130 so as to supply power to the light emitting frame 120. Accordingly, the display device 100 may supply power to the backlight unit or the light emitting frame 120 even if it includes only one backlight driver 130.

Hereinafter, operations in the disclosure will be described in more detail with reference to the drawings. Also, for the convenience of explanation and illustration, it will be described that the backlight unit is implemented as LEDs, and the light emitting frame 120 includes the LEDs, but any different types of elements may be used.

Figure 3A:
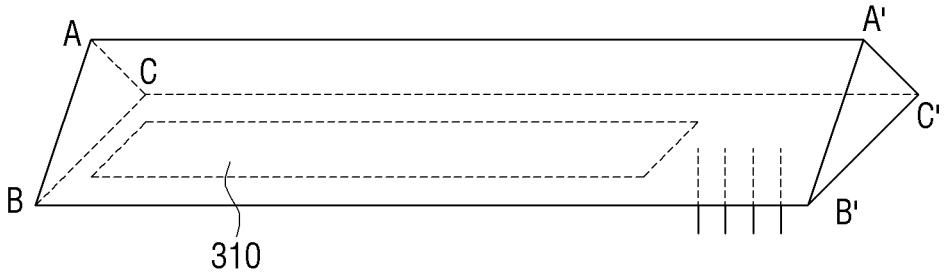
FIG. 3A and FIG. 3B are diagrams for illustrating a configuration of a light emitting frame according to an embodiment of the disclosure.
Figure 3B:
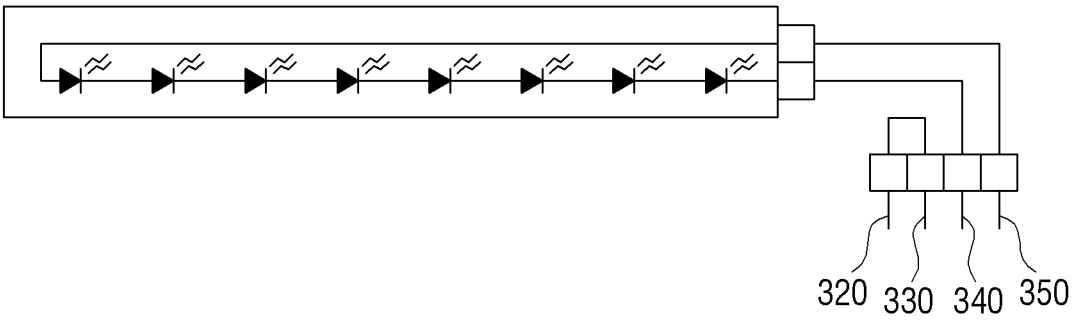

FIG. 3A and FIG. 3B are diagrams for illustrating a configuration of the light emitting frame 120 according to an embodiment of the disclosure. For the convenience of explanation, it will be described that the light emitting frame 120 in FIG. 3A and FIG. 3B is the light emitting frame arranged on the upper end of the display 110 in FIG. 1.

As illustrated in FIG. 3A, the light emitting frame 120 may include a plurality of LEDs 310 and four terminals 320, 330, 340, 350 in the lower part.

FIG. 3B is a diagram that illustrates the circuit configuration inside the light emitting frame 120, and as illustrated in FIG. 3B, the plurality of LEDs 310 may be serially connected and mounted on a printed circuit board (PCB). Two 340, 350 among the four terminals 320, 330, 340, 350 are terminals for providing constant currents to the plurality of LEDs 310, and they may be electronically connected to the both ends of the plurality of LEDs 310. The remaining two 320, 330 among the four terminals 320, 330, 340, 350 are terminals for identifying whether the light emitting frame 120 is installed on the display 110, and they may be in a state of being shorted from each other.

The processor 140 may identify whether a currently installed frame is the light emitting frame 120 or a general frame by using the remaining two terminals 320, 330. In the case of a general frame, it may include two terminals corresponding to the remaining two terminals 320, 330, but the two terminals may be in a state of not being shorted from each other.

Figure 4:
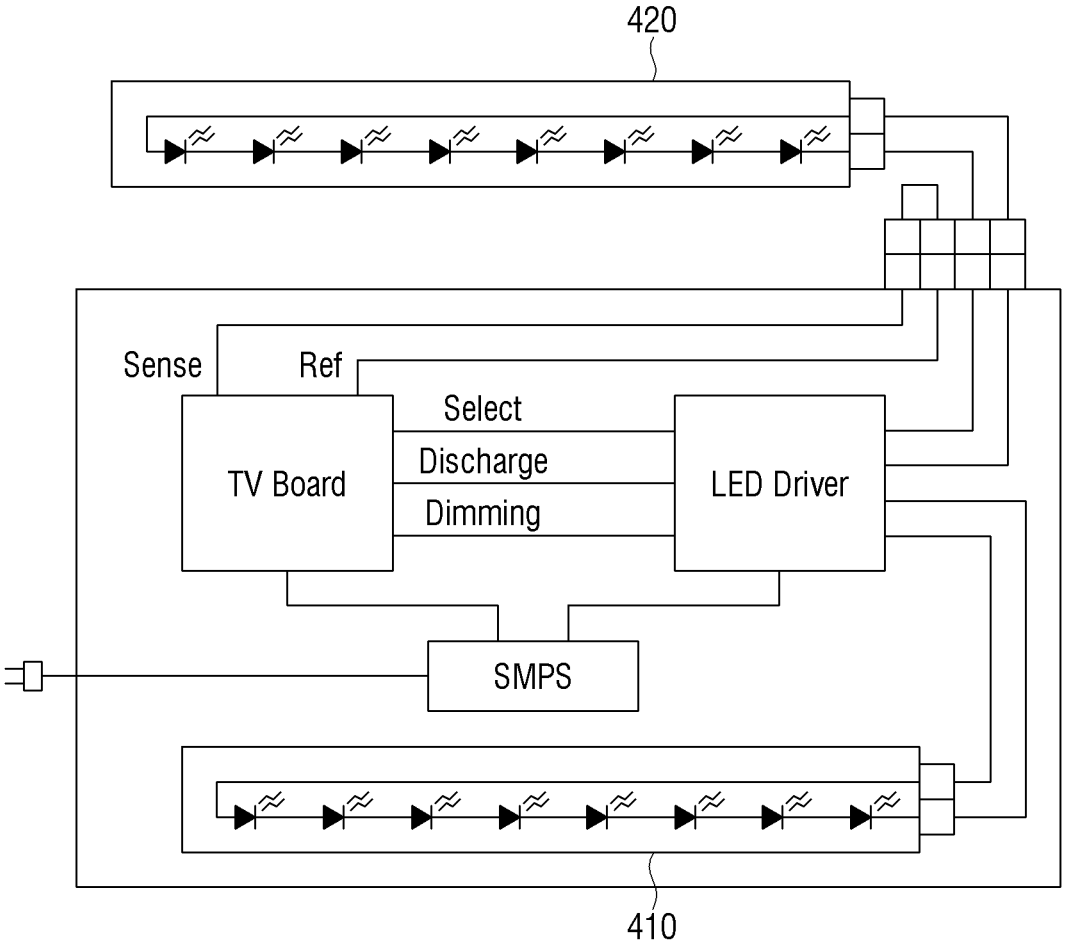
FIG. 4 is a diagram schematically illustrating a circuit configuration of a display device according to an embodiment of the disclosure.

FIG. 4 is a diagram schematically illustrating a circuit configuration of the display device 120 according to an embodiment of the disclosure.

The display device 100 may include a TV board, an LED driver, a switched mode power supply (SMPS), a plurality of first LEDs 410 included in the display 110, and a plurality of second LEDs 420 included in the light emitting frame 120.

The TV board may include the processor 140, and include other circuits that assist the processor 140. Hereinafter, for the convenience of explanation, the TV board will be described as the processor 140.

The SMPS is a component that converts common use power such as 110V, 220V, etc. into a voltage needed inside the display device, and it may supply power to the TV board and the LED driver. The LED driver is a component for supplying power to one of the display 110 or the light emitting frame 120. Hereinafter, for the convenience of explanation, the component for supplying power to one of the display 110 or the light emitting frame 120 between the SMPS and the LED driver will be described as the backlight driver 130.

The backlight driver 130 may further include a discharge circuit and a circuit for supplying power to only one of the display 110 or the light emitting frame 120 in a conventional backlight driver. That is, the function of the backlight driver 130 of supplying power is not different from the conventional function, and for this, the plurality of second LEDs 420 included in the light emitting frame 120 may be selected to be similar to the plurality of first LEDs 410 included in the display 110. For example, the type and the number of the plurality of second LEDs 420 may be selected to be the same as the type and the number of the plurality of first LEDs 410. However, the disclosure is not limited thereto, and any different types of elements can be used without a problem if the driving voltage and the driving current of the plurality of second LEDs 420 respectively have a difference smaller than a threshold value from the driving voltage and the driving current of the plurality of first LEDs 410. For example, the display device 100 may be designed such that a difference between the driving voltage of the plurality of first LEDs 410 and the driving voltage of the plurality of second LEDs 420 is a difference within a specific level such as about 10% to about 20%.

The processor 140 may control the backlight driver 130 by using a selection signal (Select), a discharge signal (Discharge), and a dimming signal (Dimming). Each of the selection signal, the discharge signal, and the dimming signal may have a value of a high level or a low level. The selection signal is a signal for selecting one of the plurality of first LEDs 410 or the plurality of second LEDs 420 connected to the backlight driver 130, and the dimming signal is a signal adjusting the brightness of a selected LED by adjusting the amount of the output current of the backlight driver 130, and it may be output by a PWM method and control the average value of the current output as an LED. The discharge signal is a signal controlling the operation of the discharge circuit inside the backlight driver 130.

Also, the processor 140 may apply a reference signal (Ref) to one of the first terminal or the second terminal included in the light emitting frame 120, and sense (Sense) a signal output from the other one of the first terminal or the second terminal and thereby identify whether the light emitting frame 120 is installed. For example, the processor 140 may apply a reference signal of a high level or a low level to one of the first terminal or the second terminal included in the light emitting frame 120, and if the signal output from the other one of the first terminal or the second terminal is identical, the processor 140 may identify that the light emitting frame 120 is installed on the display 110.

Figure 5A:
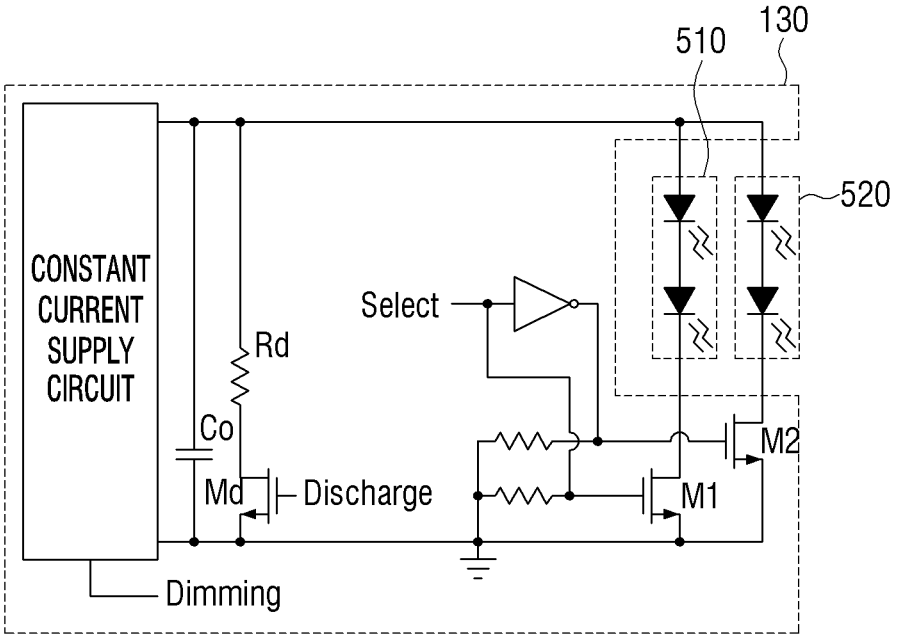
FIG. 5A and FIG. 5B are diagrams for illustrating a circuit configuration of a backlight driver according to various embodiments of the disclosure.
Figure 5B:
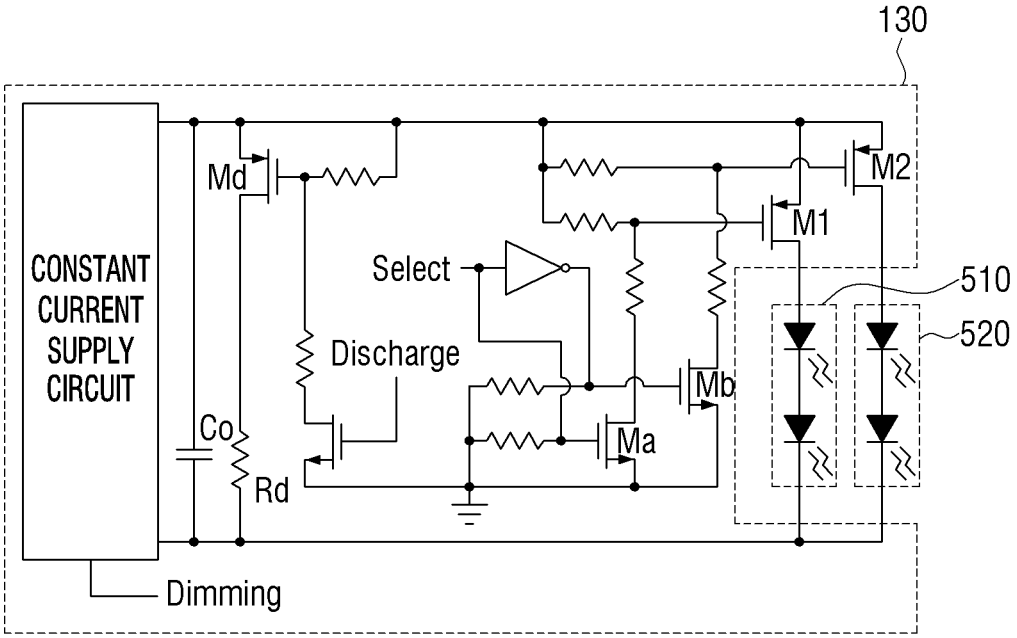

FIG. 5A and FIG. 5B are diagrams for illustrating a circuit configuration of the backlight driver 130 according to various embodiments of the disclosure.

As illustrated in FIG. 5A, the backlight driver 130 may include a constant current supply circuit adjusting a size of a constant current based on a dimming signal output from the processor 140, a discharge circuit connected to the output end of the constant current supply circuit, and a circuit for determining a subject to which power will be supplied.

Also, the backlight driver 130 may include a capacitor (Co) connected to the output end of the constant current supply circuit, and the discharge circuit may include a resistance (Rd) of which one end is connected to one end of the capacitor, and a transistor (Md) of which one end is connected to the other end of the resistance, and of which the other end is connected to the other end of the capacitor. In addition, the circuit for determining a subject to which power will be supplied may include an inverter, a first transistor (M1) which is serially connected to the plurality of first LEDs 510 included in the display 110, and of which a control terminal is connected to one of an input end of the inverter or an output end of the inverter, and a second transistor (M2) which is serially connected to the plurality of second LEDs 520 included in the light emitting frame 120, and of which a control terminal is connected to the other one of the input end of the inverter or the output end of the inverter. Also, the circuit for determining a subject to which power will be supplied may further include a first resistance of which one is connected to the control terminal of the first transistor and of which the other end is grounded, and a second resistance of which one end is connected to the control terminal of the second transistor and of which the other end is grounded.

The capacitor is an element for preventing a phenomenon that the voltage of the output end of the constant current supply circuit suddenly changes and makes the circuit unstable. Meanwhile, after a light source having a high driving voltage between the plurality of first LEDs 510 and the plurality of second LEDs 520 is driven, at the moment that the light source is switched to a light source having a low voltage, an excessive current may be applied to the light source as a voltage higher than a normal voltage is charged in the capacitor, and in this case, the light source may glare momentarily. For preventing this, a discharge circuit is provided, and the processor 140 may apply a discharge signal and control the backlight driver 130 such that the discharge circuit operates. Specifically, the processor 140 may apply a discharge signal of a high level to the control terminal of the transistor, and control the backlight driver 130 such that the voltage charged in the capacitor is discharged through the transistor and the resistance.

The processor 140 may drive the discharge circuit during a threshold time every time power is switched to the other one of the plurality of first LEDs 510 and the plurality of second LEDs 520 while power was applied to one between them. Here, the threshold time may be a time for discharging as much as the difference between the driving voltage of the plurality of first LEDs 510 and the driving voltage of the plurality of second LEDs 520, and the time spent for discharging may be implemented to be shorter by increasing the design capacity according to the capacitor and the resistance.

The processor 140 may apply a selection signal of a high level to the input end of the inverter, and thereby turn on the first transistor, and turn off the second transistor. In this case, the backlight driver 130 supplies power to the plurality of first LEDs 510. Alternatively, the processor 140 may apply a selection signal of a low level to the input end of the inverter, and thereby turn on the second transistor, and turn off the first transistor. In this case, the backlight driver 130 supplies power to the plurality of second LEDs 520.

In FIG. 5A, a circuit configuration where a cathode voltage of an LED is fixed is illustrated, but a circuit may be configured in a form where an anode voltage of an LED is fixed as in FIG. 5B.

As illustrated in FIG. 5B, the backlight driver 130 may include a constant current supply circuit adjusting a size of a constant current based on a dimming signal output from the processor 140, a discharge circuit connected to the output end of the constant current supply circuit, and a circuit for determining a subject to which power will be supplied.

Also, the backlight driver 130 may include a capacitor (Co) connected to the output end of the constant current supply circuit, and the discharge circuit may include a resistance (Rd) of which one end is connected to one end of the capacitor, a transistor (Md) of which one end is connected to the other end of the resistance, and of which the other end is connected to the other end of the capacitor, a resistance of which one end is connected to the control terminal of the transistor (Md), and of which the other end is connected to the other end of the transistor (Md), a resistance of which one end is connected to the control terminal of the transistor (Md), and of which the other end is connected to one end of a control transistor, and a control transistor of which the other end is grounded, and of which a control terminal is connected to the terminal outputting a discharge signal of the processor 140.

The circuit for determining a subject to which power will be supplied may include an inverter, a first relay transistor (Ma) of which a control terminal is connected to one of an input end of the inverter or an output end of the inverter, and of which one end is grounded, a second relay transistor (Mb) of which a control terminal is connected to the other one of the input end of the inverter or the output end of the inverter, and of which one end is grounded, a first transistor (M1) of which a control terminal connects the other end of the capacitor and the other end of the first relay transistor in a form of voltage distribution, and which is serially connected to the plurality of first LEDs 510 included in the display 110, and a second transistor (M2) of which a control terminal connects the other end of the capacitor and the other end of the second relay transistor in a form of voltage distribution, and which is serially connected to the plurality of second LEDs 520 included in the light emitting frame 120. Also, the circuit for determining a subject to which power will be supplied may further include a first resistance of which one end is connected to the control terminal of the first relay transistor and of which the other end is grounded, and a second resistance of which one end is connected to the control terminal of the second relay transistor and of which the other end is grounded.

As the specific operation is similar to what is described in FIG. 5A, description in that regard will be omitted.

Figure 6:
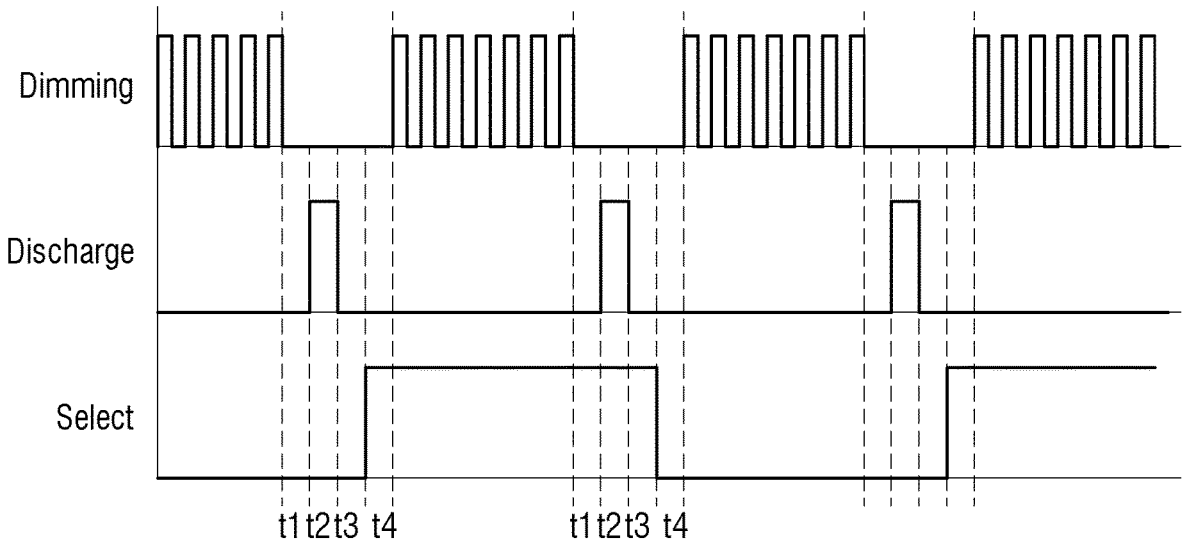
FIG. 6 is a timing diagram for illustrating a method for applying a plurality of control signals according to an embodiment of the disclosure.

FIG. 6 is a timing diagram for illustrating a method for applying a plurality of control signals according to an embodiment of the disclosure.

As illustrated in FIG. 6, a dimming signal may be output in a form of a square wave which periodically outputs a high level and a low level alternatingly. When a dimming signal is a high level, the constant current supply circuit may output a current, and thus the LEDs connected to the backlight driver 130 may be turned on, and when a dimming signal is a low level, the constant current supply circuit may not output a current, and thus the LEDs connected to the backlight driver 130 may be turned off. A frequency of a dimming signal may be set to be high to the degree that it is difficult to distinguish turning-on and turning-off of an LED light source with a human eye, and a human eye can recognize the average brightness that is adjusted according to the ratios of a turning-on section and a turning-off section of an LED light source.

If an event changing the display 110 from a turned-on or turned-off state to the other state occurs, the processor 140 may stop output of the dimming signal and apply a discharge signal to the backlight driver 130 such that the discharge circuit operates during a first threshold time t2.

The discharge signal is a signal that discharges the capacitor connected to the output end of the constant current supply circuit, and the processor 140 may first stop output of a dimming signal and thereby make a current not supplied to the capacitor anymore. Afterwards, the processor 140 may apply a discharge signal to the backlight driver 130 and thereby discharge the capacitor. The processor 140 may apply a discharge signal to the backlight driver 130 after a threshold time t1 from the time point when the output of the dimming signal was stopped.

After discharging the capacitor during the first threshold time t2, the processor 140 may change the level of the selection signal and thereby switch the light source to which the backlight driver 130 supplies power. After changing the level of the selection signal, the processor 140 may output the dimming signal after a second threshold time t4.

In the cases of t1, t2, and t4 in FIG. 6, a specific time is needed, but in the case of t3, a specific time is not needed. That is, there is no problem even if a selection signal is applied while a discharge signal is applied.

Figure 7A:
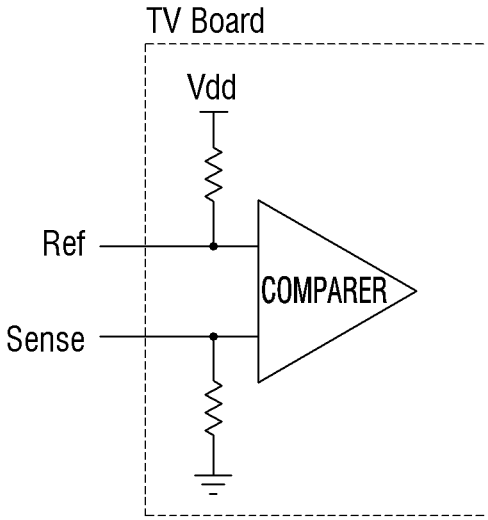
FIG. 7A to FIG. 7C are circuits for identifying whether a light emitting frame is installed according to various embodiments of the disclosure.
Figure 7B:
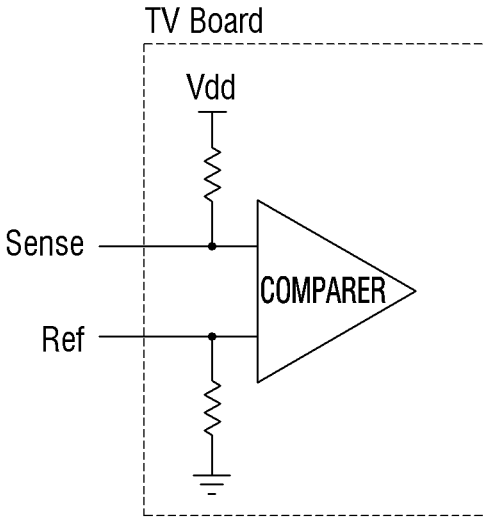
Figure 7C:
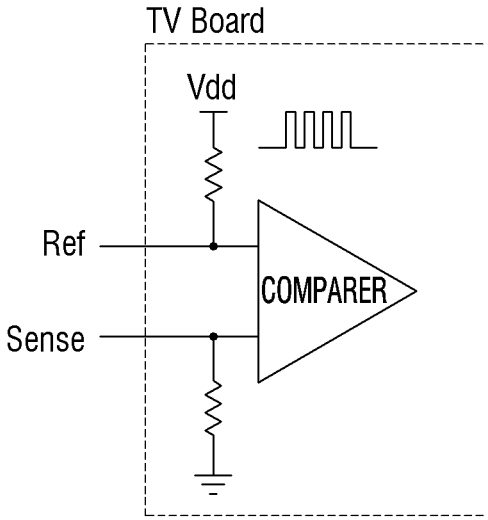

FIG. 7A to FIG. 7C are circuits for identifying whether the light emitting frame 120 is installed according to various embodiments of the disclosure.

The processor 140 may include a reference (Ref) terminal and a sense (Sense) terminal, and the reference terminal and the sense terminal may be connected with the two terminals of the light emitting frame 120 through the inside of the display device 100.

As illustrated in FIG. 7A, the reference terminal may be connected to a pull-up resistance and may be a high level, and the sense terminal may be connected to a pull-down resistance and may be a low level. In this case, a reference signal of a high level may be applied to the light emitting frame 120 through the reference terminal, and if a high level is received through the sense terminal and it is identified that two inputs of the comparer are identical, the processor 140 may identify that the light emitting frame 120 is installed.

Alternatively, as in FIG. 7B, the reference terminal may be connected to a pull-down resistance and may be a low level, and the sense terminal may be connected to a pull-up resistance and may be a high level. Alternatively, as in FIG. 7C, the processor 140 may output a signal having a predetermined waveform through the reference terminal, and the sense terminal may be in a state of being connected to a pull-down resistance. In both of FIG. 7B and FIG. 7C, it may be determined whether the light emitting frame 120 is installed by determining whether the signals of the reference terminal and the sense terminal are identical through the comparer.

Figure 8A:
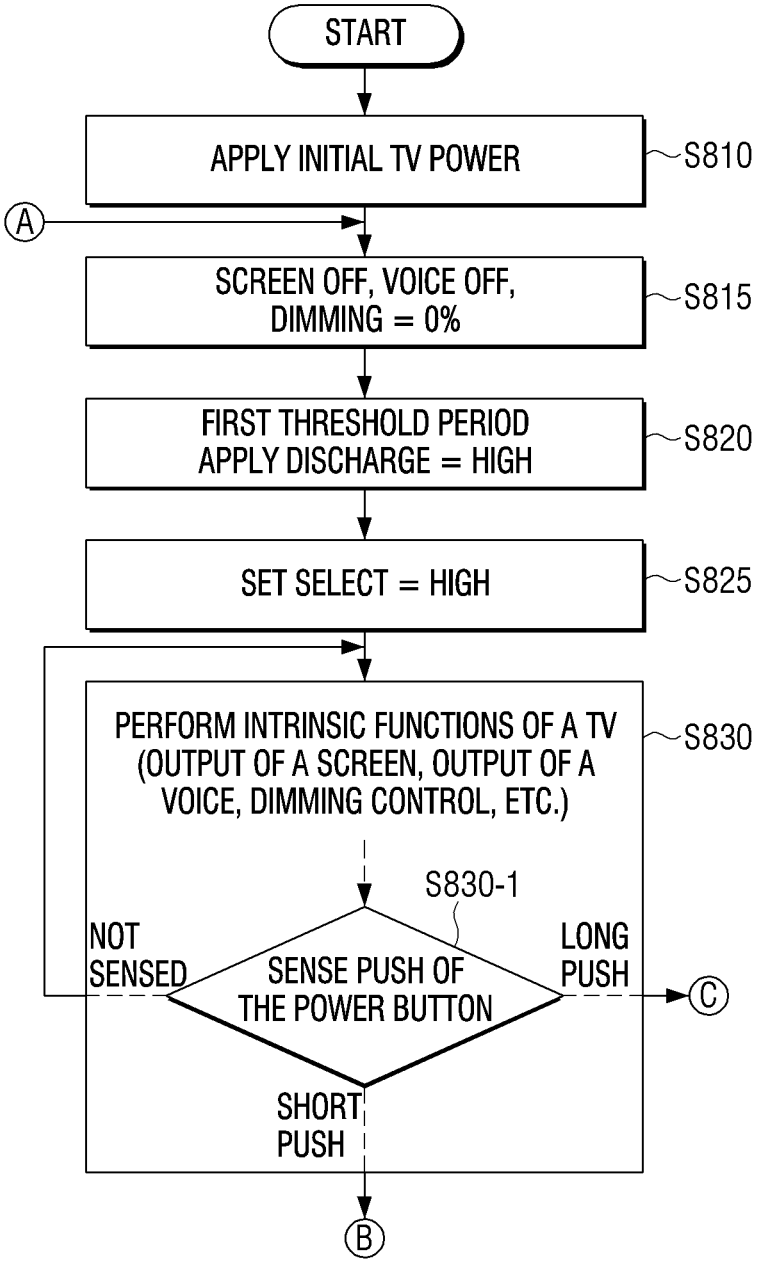
FIG. 8A to FIG. 8C are diagrams for illustrating operations for a plurality of modes according to an embodiment of the disclosure.
Figure 8B:
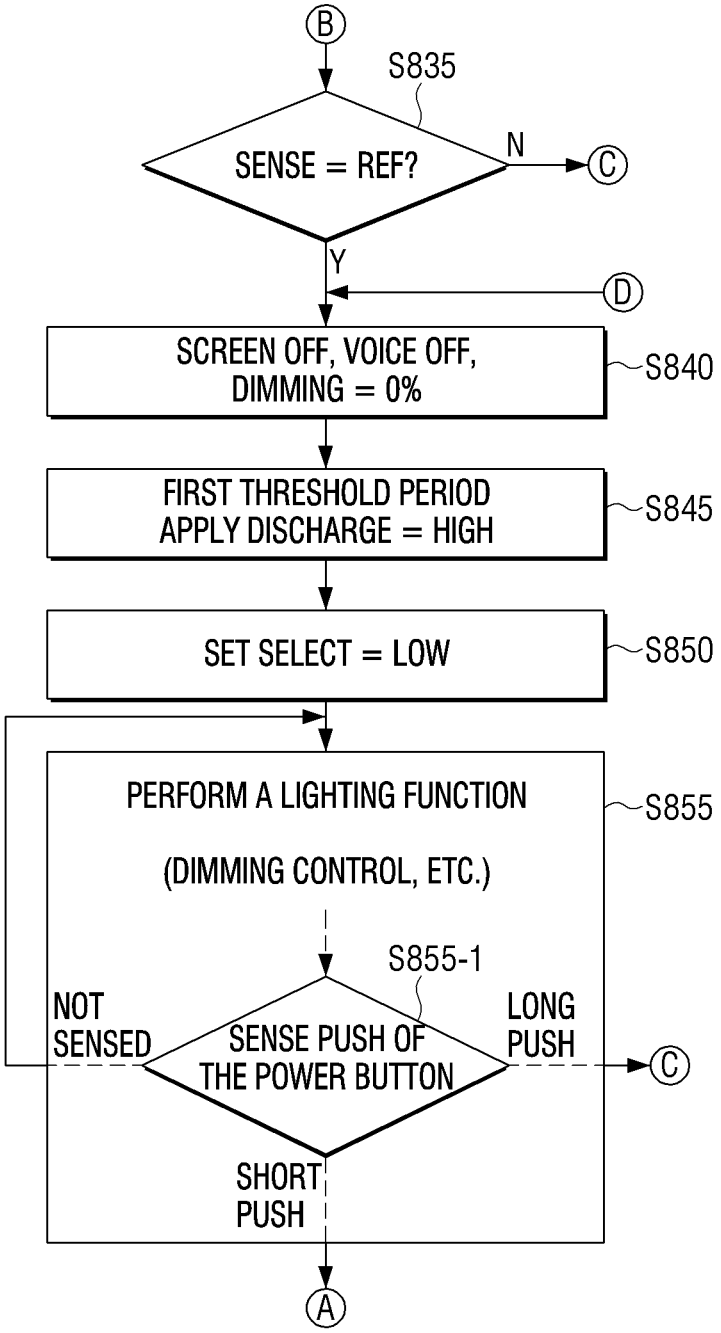
Figure 8C:
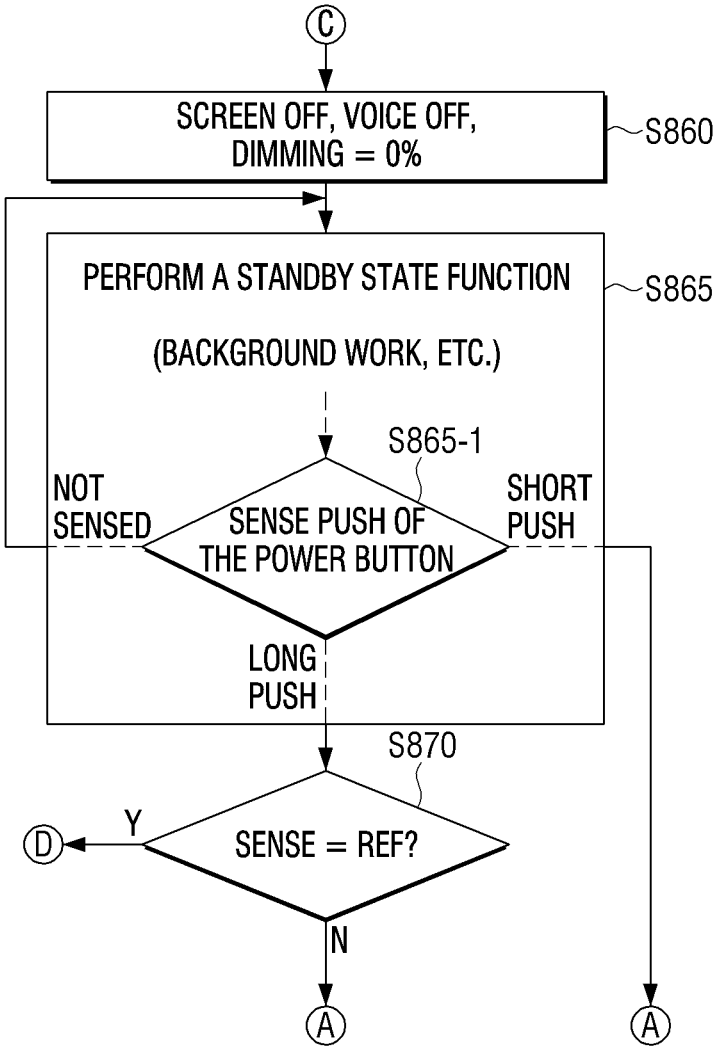

FIG. 8A to FIG. 8C are diagrams for illustrating operations for a plurality of modes according to an embodiment of the disclosure. In FIG. 8A to FIG. 8C, a display mode, a lighting mode, and an OFF mode were assumed, and the display mode is identical to a general turned-on state of the display device 100, and the light source of the light emitting frame 120 may be in a turned-off state. In the lighting mode, both of the screen and the sound of the display device 100 are turned off, and thus the mode is similar to a general turned-off state of the display device 100, but the light source of the light emitting frame 120 may be turned on and may be in a state of functioning as a lighting. In the display mode, a user may manipulate a remote control and thereby adjust the brightness of the light source of the light emitting frame 120, and the processor 140 may maintain a minimum operating state for this. The OFF mode is identical to a general turned-off state of the display device 100, and the light source of the light emitting frame 120 may also be in a turned-off state. The processor 140 may maintain a minimum operating state for sensing a remote control manipulation or a power switch manipulation, etc., for releasing the OFF mode. Alternatively, in the case of the display device 100 connected to the Internet during the OFF mode, a background work such as software upgrade may be performed.

Hereinafter, for the convenience of explanation, it will be described that the display device 100 is a TV, and the initial mode is the display mode.

First, as illustrated in FIG. 8A, if power is initially applied to the display device 100, the processor 140 may enter the display mode in operation S810. Here, it is assumed that the initial mode is the display mode, but the disclosure is not limited thereto, and the initial mode may be the lighting mode. The initial mode may also be set by a user.

The processor 140 may turn off output of a screen and a voice, and stop output of a dimming signal in operation S815. Then, the processor 140 may apply a discharge signal during a first threshold time in operation S820, and set a selection signal as a high level in operation S825. Afterwards, the processor 140 may perform intrinsic functions of a TV such as output of a screen, output of a voice, dimming control, etc., in operation S830. While performing the intrinsic functions of a TV, the processor 140 may identify whether a push of the power button was sensed in operation S830-1. If a push of the power button was not sensed, the processor 140 may keep performing the intrinsic functions of a TV.

If a push of the power button is sensed as a short push, the processor 140 enters the step B in FIG. 8B, and if a push of the power button is sensed as a long push, the processor 140 enters the step C in FIG. 8C.

First, describing the lighting mode in FIG. 8B, the processor 140 may identify whether a reference signal is received through the sense terminal in operation S835. If a reference signal is not received through the sense terminal, the processor 140 enters the step C in FIG. 8C.

If a reference signal is received through the sense terminal, the processor 140 may turn off output of a screen and a voice, and stop output of the dimming signal in operation S840. Then, the processor 140 may apply a discharge signal during the first threshold time in operation S845, and set the selection signal as a low level in operation S850. Afterwards, the processor 140 may perform a lighting function such as dimming control in operation S855. While performing the lighting function, the processor 140 may identify whether a push of the power button was sensed in operation S855-1. If a push of the power button is not sensed, the processor 140 may keep performing the lighting function.

If a push of the power button is sensed as a short push, the processor 140 enters the step A in FIG. 8A, and if push of the power button is sensed as a long push, the processor 140 enters the step C in FIG. 8C.

Describing the OFF mode in FIG. 8C, the processor 140 may turn off output of a screen and a voice, and stop output of the dimming signal in operation S860. Afterwards, the processor 140 may perform a standby state function such as a background work in operation S865. While performing the standby state function, the processor 140 may identify whether a push of the power button was sensed in operation S865-1. If a push of the power button is not sensed, the processor 140 may keep performing the standby state function.

If a push of the power button is sensed as a short push, the processor 140 enters the step A in FIG. 8A, and if push of the power button is sensed as a long push, the processor 140 may identify whether a reference signal is received through the sense terminal in operation S875. If a reference signal is not received through the sense terminal, the processor 140 may enter the step A in FIG. 8A. Alternatively, if a reference signal is received through the sense terminal, the processor 140 may enter the step D in FIG. 8B.

As described above, a user may use three operating modes by manipulating only one power button. Also, the user may adjust the brightness of the light source by manipulating a volume up/down button or a channel up/down button, etc., while the processor 140 performs the lighting function. Accordingly, even if the lighting mode is added in the conventional display mode and OFF mode, there is no need that a separate button is included.

Meanwhile, the three operating modes as above are effective in case the light emitting frame 120 is installed on the display 110. That is, in case a general frame but not the light emitting frame 120 is installed on the display 110, the processor 140 may operate only in the display mode and the OFF mode, and there may be no difference in the time of manipulating the power button.

Figure 9:
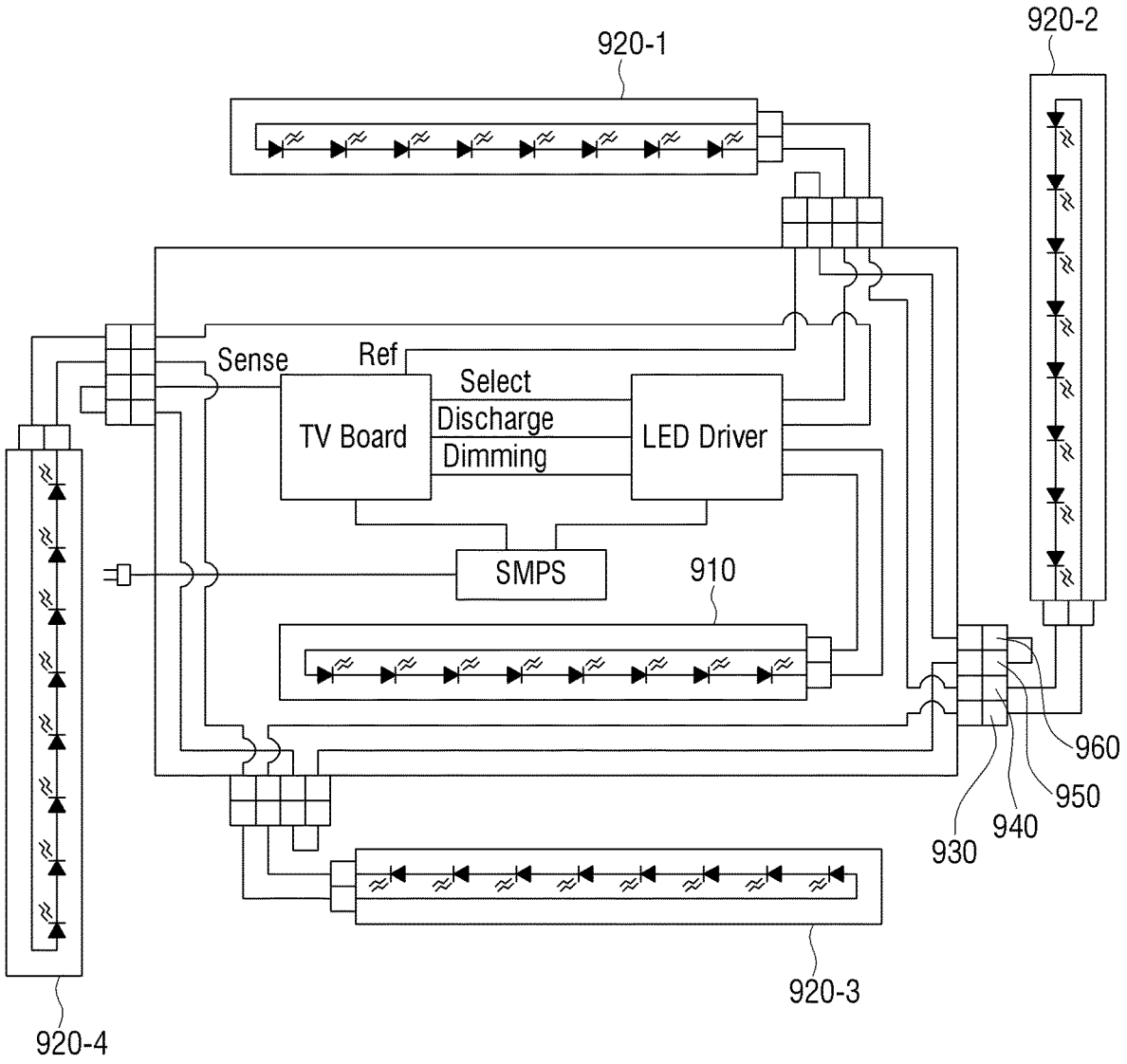
FIG. 9 is a diagram schematically illustrating a circuit configuration of a display device according to another embodiment of the disclosure.

FIG. 9 is a diagram schematically illustrating a configuration of a circuit of the display device 100 according to another embodiment of the disclosure.

In FIG. 4, it was described that the light emitting frame 120 is formed on one edge of the display 110, but as in FIG. 9, a plurality of light emitting frames may be formed on all edges of the display 110. In this case, the display device 100 may further include a plurality of second LEDs 920-1 to 920-4 included in the plurality of light emitting frames other than the plurality of first LEDs 910 included in the display 110.

In the same manner as the light emitting frame including the plurality of second LEDs 920-1 formed on the upper side of the display 110, the light emitting frame including the plurality of second LEDs 920-2 formed on the right side of the display 110 may include four terminals 930, 940, 950, 960, and the two terminals 930, 940 may be terminals for supplying power to the plurality of second LEDs 920-2, and the remaining two terminals 950, 960 may be terminals for identifying whether the light emitting frames are installed.

In FIG. 9, terminals for identifying whether the light emitting frames are installed included in each of the four light emitting frames are serially connected, and thus the processor 140 may sense whether the light emitting frames are installed only when all of the four light emitting frames are connected, and if any one of the four is not connected, it is identified that the entire light emitting frames are not installed. However, this is merely an embodiment, and the processor 140 may be individually connected to the terminals for identifying whether each of the four light emitting frames is installed, and sense whether each of the four light emitting frames is installed.

Also, in FIG. 9, terminals for supplying power included in each of the light emitting frames are serially connected, and thus the processor 140 may apply power to the plurality of second LEDs 920-1 to 920-4 only when all of the four light emitting frames are connected, and if any one of the four is not connected, the entire light emitting frames do not emit lights. However, this is merely an embodiment, and in a general frame, terminals for supplying power are shorted from one another, and thus the electronic device 100 may be implemented such that, even if a general frame is connected, the plurality of second LEDs included in the remaining light emitting frames emit lights.

In addition, in FIG. 9, it was described that there are four light emitting frames, but this is merely an embodiment, and the display device 100 may be implemented by a method as above only if there are a plurality of light emitting frames.

Figure 10A:
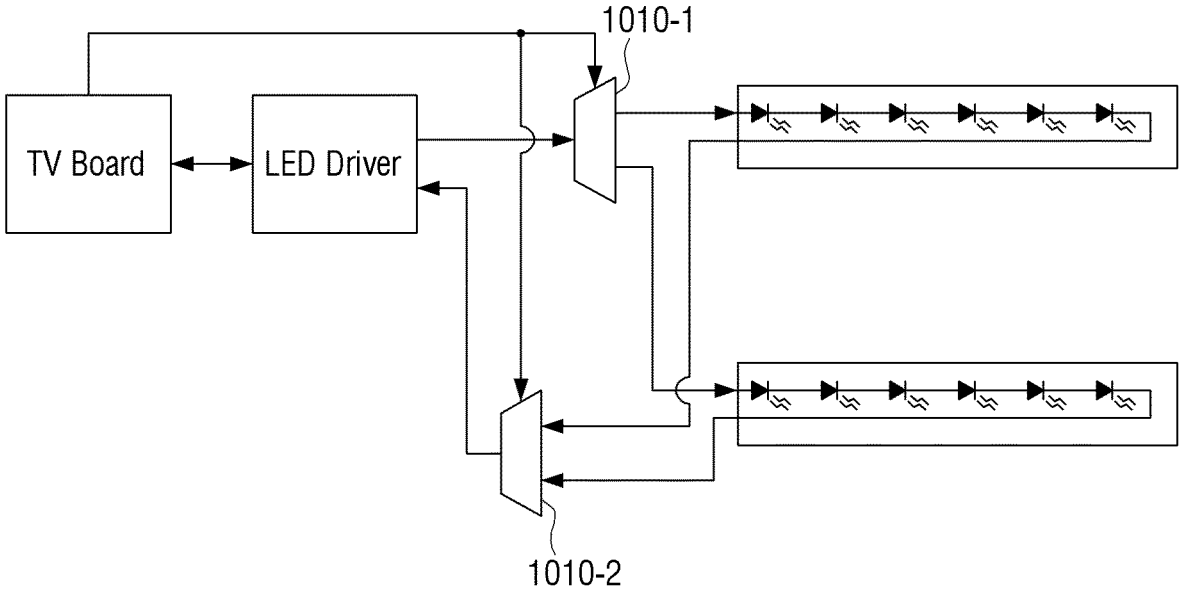
FIG. 10A and FIG. 10B are diagrams for illustrating extended embodiments of the disclosure.
Figure 10B:
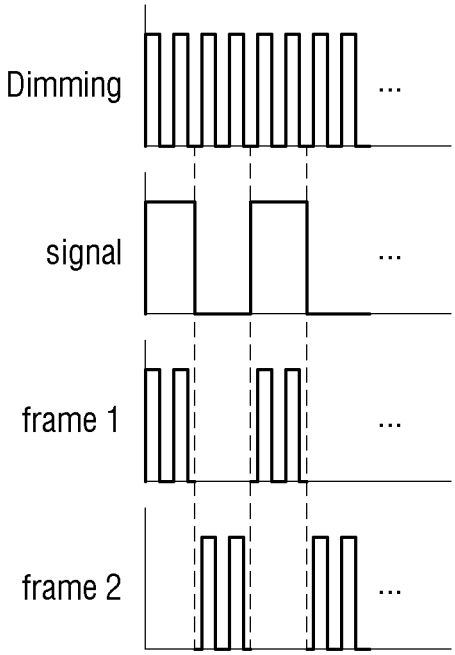

FIG. 10A and FIG. 10B are diagrams for illustrating extended embodiments of the disclosure.

FIG. 10A illustrates a case where the display device 100 includes a plurality of first LEDs (e.g., upper LEDs) included in the first light emitting frame and a plurality of second LEDs (e.g., lower LEDs) included in the second light emitting frame, other than the backlight unit (not shown) included in the display 110. Here, the plurality of first LEDs and the plurality of second LEDs are of different types from each other, and their driving voltages, the wavelengths of emitted lights, etc. may be different from each other.

In FIG. 10A, it is illustrated that the backlight driver (e.g., an LED driver) 130 is connected with a de-multiplexer 1010-1 and a multiplexer 1010-2, but the backlight driver 130 is in a state of being separately connected with the backlight unit (not shown) included in the display 110, and this is omitted.

The processor (e.g., a TV board) 140 may drive the plurality of first LEDs and the plurality of second LEDs by time-sharing them, by controlling the de-multiplexer 1010-1 and the multiplexer 1010-2.

The processor 140 may control the de-multiplexer 1010-1 and the multiplexer 1010-2 through a control signal (signal). For example, if a control signal is a high level, the de-multiplexer 1010-1 may provide constant currents applied from the backlight driver to the plurality of first LEDs, and the multiplexer 1010-2 may provide the constant currents output from the plurality of first LEDs to the backlight driver. Alternatively, if a control signal is a low level, the de-multiplexer 1010-1 may provide constant currents applied from the backlight driver to the plurality of second LEDs, and the multiplexer 1010-2 may provide the constant currents output from the plurality of second LEDs to the backlight driver.

FIG. 10B illustrates a case where, even if regular dimming signals are applied, constant currents according to the dimming signals are applied to only one of the first light emitting frame (frame 1) or the second light emitting frame (frame 2) according to a control signal. In FIG. 10B, the signals of the first light emitting frame (frame 1) and the second light emitting frame (frame 2) are indicated as dimming signals, but this is merely an illustration for explaining influences of dimming signals, and in actuality, constant currents may be applied to the first light emitting frame (frame 1) and the second light emitting frame (frame 2).

Through such an operation, one backlight driver 130 may be used even if different types of LEDs are used. In particular, as dimming signals are applied through time-sharing, a person may identify that all of the different types of LEDs are turned on.

Also, in FIG. 10A, it was described that the de-multiplexer 1010-1 includes two output ports, and the multiplexer 1010-2 includes two input ports, but the disclosure is not limited thereto. For example, the de-multiplexer 1010-1 may include four output ports, and the multiplexer 1010-2 may include four input ports, and they may be connected to the four light emitting frames installed on the four edges of the display 110.

Alternatively, the de-multiplexer 1010-1 may include spare output ports, and the multiplexer 1010-2 may include spare input ports, and they may operate such that constant currents are applied to only some of the plurality of light emitting frames. Here, the spare output ports of the de-multiplexer 1010-1 may be in a state of being shorted from the spare input ports of the multiplexer 1010-2.

For example, in FIG. 10A, in case the de-multiplexer 1010-1 includes additional output ports other than the two output ports, and the multiplexer 1010-2 includes additional input ports other than the two input ports, the processor 140 may make constant currents flow into the additional output ports and the additional input ports, and thereby make all of the plurality of first LEDs and the plurality of second LEDs not emit lights. In this case, through time-sharing control of the de-multiplexer 1010-1 and the multiplexer 1010-2 by the processor 140, the LEDs may be controlled such that only one of the plurality of first LEDs or the plurality of second LEDs emit lights.

Figure 11:
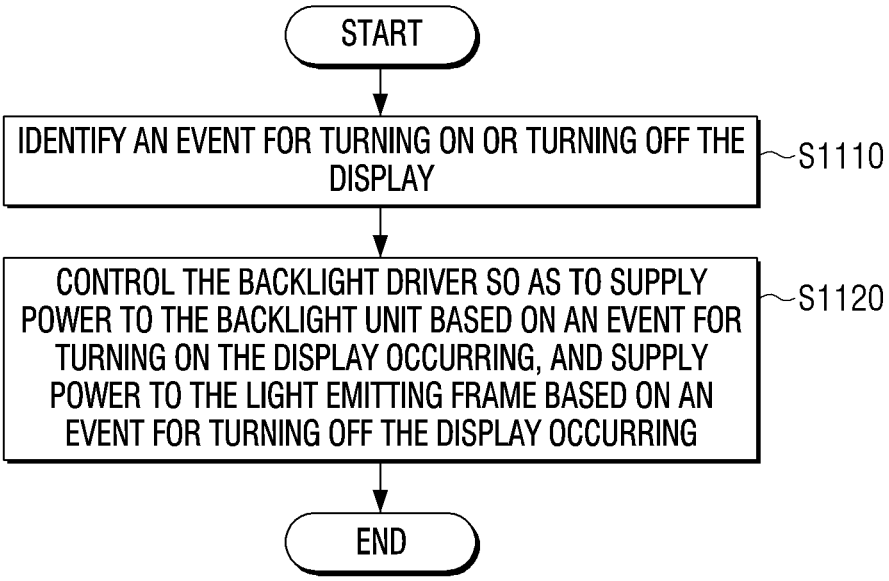
FIG. 11 is a flowchart for illustrating a method for controlling a display device according to an embodiment of the disclosure.

FIG. 11 is a flowchart for illustrating a method for controlling a display device according to an embodiment of the disclosure.

Here, the display device may include a display including a display panel and a backlight unit arranged on the rear surface of the display panel, a light emitting frame which includes a plurality of light emitting elements and which is arranged on at least one edge of the display, and a backlight driver.

In the control method, first, an event for turning on or turning off the display is identified in operation S1110. Then, if an event for turning on the display occurs, the backlight driver may be controlled so as to supply power to the backlight unit based on an event for turning on the display occurring, and supply power to the light emitting frame based on an event for turning off the display occurring in operation S1120.

Here, in the controlling step S1120, based on an event for turning off the display occurring, the backlight driver may be controlled so as to stop supply of power to the backlight unit, and supply power to the light emitting frame.

Alternatively, in the controlling step S1120, based on an event for turning on the display occurring, the backlight driver may be controlled so as to stop supply of power to the light emitting frame, and supply power to the backlight unit.

Here, the controlling step S1120 may include the steps of applying a dimming signal to the backlight driver and adjusting a size of a constant current output from a constant current supply circuit included in the backlight driver, and providing the constant current to one of the backlight unit or the light emitting frame based on a level of a selection signal applied to the backlight driver.

Also, the controlling step S1120 may include the steps of, based on an event changing the display from a turned-on or turned-off state to the other state occurring, stopping output of the dimming signal, controlling the backlight driver such that a discharge circuit connected to an output end of the constant current supply circuit operates during a first threshold time, and outputting the dimming signal after a second threshold time after changing the level of the selection signal.

Here, in the step of controlling the backlight driver such that the discharge circuit operates, at least one of whether the discharge circuit operates or an operating time may be identified based on a driving voltage of the backlight unit and a driving voltage of the light emitting frame.

Alternatively, the first threshold time may be determined based on the driving voltage of the backlight unit and the driving voltage of the light emitting frame.

Meanwhile, the discharge circuit may include a resistance of which one end is connected to one end of a capacitor connected to the output end of the constant current supply circuit, and a transistor of which one end is connected to the other end of the resistance, and of which the other end is connected to the other end of the capacitor. Also, in the step of controlling the backlight driver such that the discharge circuit operates, an operation of the discharge circuit may be controlled by applying a discharge signal to a control terminal of the transistor.

Further, the backlight driver may include an inverter, a first transistor which is serially connected to the backlight unit, and of which a control terminal is connected to one of an input end of the inverter or an output end of the inverter, and a second transistor which is serially connected to the plurality of light emitting elements included in the light emitting frame, and of which a control terminal is connected to the other one of the input end of the inverter or the output end of the inverter. In addition, in the step of providing, the selection signal may be applied to the input end of the inverter and the backlight driver may be controlled such that the constant current is provided to one of the backlight unit or the light emitting frame.

Meanwhile, the control method may further include the steps of applying a reference signal to one of a first terminal which is included in the light emitting frame or a second terminal which is included in the light emitting frame and which is shorted from the first terminal, and identifying whether the light emitting frame is installed based on whether the reference signal is detected from the other one of the first terminal or the second terminal.

Here, in the controlling step S1120, based on identifying that the light emitting frame is not installed on the display device, if an event for turning off the display occurs, the driving of the backlight driver may be stopped.

Meanwhile, the light emitting frame may include a shield for shielding emission of a light emitted from the light emitting frame to the front side of the display device.

According to the various embodiments of the disclosure as described above, a display device operates as a lighting, and thus its usability is reinforced, and as there is no need to include a separate backlight driver, the production cost can be reduced.

Meanwhile, according to an embodiment of the disclosure, the various embodiments described above may be implemented as software including instructions stored in machine-readable storage media, which can be read by machines (e.g.: computers). Here, the machines refer to devices that call instructions stored in a storage medium, and can operate according to the called instructions, and the devices may include the electronic device according to the aforementioned embodiments (e.g.: an electronic device A). In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. Here, the term 'non-transitory' only means that a storage medium does not include signals, and is tangible, but does not indicate whether data is stored in the storage medium semi-permanently or temporarily.

Also, according to an embodiment of the disclosure, the method according to the various embodiments described above may be provided while being included in a computer program product. A computer program product refers to a product, and it can be traded between a seller and a buyer. A computer program product can be distributed in the form of a storage medium that is readable by machines (e.g.: a compact disc read only memory (CD-ROM)), or distributed on-line through an application store (e.g.: Play Store™). In the case of on-line distribution, at least a portion of a computer program product may be stored in a storage medium such as the server of the manufacturer, the server of the application store, and the memory of the relay server at least temporarily, or may be generated temporarily.

Further, according to an embodiment of the disclosure, the aforementioned various embodiments of the disclosure may be implemented in a recording medium that can be read by a computer or a device similar to a computer by using software, hardware or a combination thereof. In some cases, the embodiments described in this specification may be implemented as the processor itself. According to implementation by software, the embodiments such as procedures and functions described in this specification may be implemented as separate software modules. Each of the software modules may perform one or more functions and operations described in this specification.

Meanwhile, computer instructions for performing processing operations of machines according to the aforementioned various embodiments may be stored in a non-transitory computer-readable medium. Computer instructions stored in such a non-transitory computer-readable medium make the processing operations at machines according to the aforementioned various embodiments performed by a specific machine, when the instructions are executed by the processor of the specific machine. A non-transitory computer-readable medium refers to a medium that stores data semi-permanently, and is readable by machines, but not a medium that stores data for a short moment such as a register, a cache, and a memory. As specific examples of a non-transitory computer-readable medium, there may be a CD, a digital versatile disc (DVD), a hard disc, a blue-ray disc, a universal serial bus (USB) drive, a memory card, a ROM and the like.

Also, each of the components (e.g.: a module or a program) according to the aforementioned various embodiments may be comprised of a single entity or a plurality of entities, and some sub-components among the aforementioned sub-components may be omitted, or different sub-components may be further included in the various embodiments. Alternatively or additionally, some components (e.g.: modules or programs) may be integrated into one entity to perform the same or similar functions performed by each component prior to integration. Operations performed by a module, a program, or another component, in accordance with the various embodiments, may be performed sequentially, in parallel, repetitively, or in a heuristic manner, or at least some operations may be performed in a different order, omitted, or a different operation may be added.

So far, preferred embodiments of the disclosure have been shown and described, but the disclosure is not limited to the aforementioned specific embodiments, and it is apparent that various modifications may be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. A display device comprising:

a display including a display panel and a backlight unit arranged on a rear surface of the display panel;

a light emitting frame including a plurality of light emitting elements, the light emitting frame being arranged on at least one edge of the display;

a backlight driver; and a processor configured to:

control the backlight driver so as to supply power to the backlight unit based on an event for turning on the display occurring, and supply power to the light emitting frame based on an event for turning off the display occurring, wherein the backlight driver comprises:

a constant current supply circuit which adjusts a size of a constant current based on a dimming signal output from the processor;

an inverter;

a first transistor which is serially connected to the backlight unit, and of which a control terminal is connected to one of an input end of the inverter or an output end of the inverter; and a second transistor which is serially connected to the plurality of light emitting elements included in the light emitting frame, and of which a control terminal is connected to the input end of the inverter when the control terminal of the first transistor is connected to the output end of the inverter or the output end of the inverter when the control terminal of the first transistor is connected to the input end of the inverter; and wherein the processor is further configured to:

apply a selection signal to the input end of the inverter and control the backlight driver such that the constant current is provided to one of the backlight unit or the light emitting frame.

2. The display device of claim 1, wherein the processor is further configured to:

based on the event for turning off the display occurring, control the backlight driver so as to stop supply of power to the backlight unit, and supply power to the light emitting frame.

3. The display device of claim 1, wherein the backlight driver further comprises a discharge circuit connected to an output end of the constant current supply circuit, and wherein the processor is further configured to:

based on an event changing the display from a turned-on state to a turned-off state or from a turned-off state to a turned-on state occurring, stop output of the dimming signal and control the backlight driver such that the discharge circuit operates during a first threshold time, and output the dimming signal after a second threshold time after changing a level of the selection signal.

4. The display device of claim 3, wherein the processor is further configured to:

based on the event changing the display from a turned-on state to a turned-off state or from a turned-off state to a turned-on state, stop output of the dimming signal and identify at least one of:

whether the discharge circuit operates, or an operating time based on a driving voltage of the backlight unit and a driving voltage of the light emitting frame.

5. The display device of claim 3, wherein the first threshold time is determined based on a driving voltage of the backlight unit and a driving voltage of the light emitting frame.

6. The display device of claim 3, wherein the backlight driver further comprises a capacitor connected to an output end of the constant current supply circuit, and wherein the discharge circuit comprises:

a resistance of which one end is connected to one end of the capacitor; and a transistor of which one end is connected to an other end of the resistance, and of which an other end is connected to the other end of the capacitor, and wherein the processor is further configured to:

control an operation of the discharge circuit by applying a discharge signal to a control terminal of the transistor.

7. The display device of claim 1, wherein the light emitting frame further comprises:

a first terminal and a second terminal shorted from the first terminal, and wherein the processor is further configured to:

apply a reference signal to one of the first terminal or the second terminal, and identify whether the light emitting frame is installed based on whether the reference signal is detected from the first terminal when the reference signal is applied to the second terminal or the second terminal when the reference signal is applied to the first terminal.

8. The display device of claim 7, wherein the processor is further configured to:

based on identifying that the light emitting frame is not installed on the display device, if the event for turning off the display occurs, stop driving of the backlight driver.

9. The display device of claim 1, wherein the light emitting frame further comprises a shield for shielding emission of a light emitted from the light emitting frame to a front side of the display device.

* * * * *